US006435936B1

(12) United States Patent
Rehkemper et al.

(10) Patent No.: US 6,435,936 B1
(45) Date of Patent: Aug. 20, 2002

(54) INTERACTIVE ROLE-PLAYING POSABLE TOY

(75) Inventors: Steven Rehkemper; Jeffrey Rehkemper, both of Chicago; Kerry E. Phillips, South Holland; Ryan Kratz, Chicago; Peter Greenley, Chicago; Michael Kass, Chicago, all of IL (US)

(73) Assignee: Rehco, LLC, Chicago, IL (US)

( * ) Notice: Subject to any disclaimer, the term of this patent is extended or adjusted under 35 U.S.C. 154(b) by 162 days.

(21) Appl. No.: 09/631,923

(22) Filed: Aug. 3, 2000

(51) Int. Cl.[7] ..... A63H 3/28; A63H 3/46

(52) U.S. Cl. ..... 446/297; 446/298; 446/376; 446/390

(58) Field of Search ..... 446/297, 298, 446/376, 378, 383, 390, 91

(56) References Cited

U.S. PATENT DOCUMENTS

| | | | | | |
|---|---|---|---|---|---|
| 3,755,960 | A | * | 9/1973 | Tepper | 446/297 |
| 4,179,842 | A | * | 12/1979 | Fauls | 446/297 |
| 4,869,701 | A | * | 9/1989 | Kawai | 446/91 |
| 5,295,889 | A | * | 3/1994 | Ejima | 446/91 |
| 5,346,418 | A | * | 9/1994 | Arad | 446/91 |
| 6,126,509 | A | * | 10/2000 | Berman | 446/418 |

FOREIGN PATENT DOCUMENTS

| | | | | |
|---|---|---|---|---|
| GB | 2250688 | * | 8/1991 | A63H/3/33 |

* cited by examiner

*Primary Examiner*—Kien T. Nguyen
*Assistant Examiner*—Kurt Fernstrom

(57) ABSTRACT

In accordance with the present invention, there is provided an interactive posable toy that when positioned in various configurations, emits electronic sounds and/or produces motions indicative of such configurations. The posable toy includes a head pivotally attached to an upper torso. The upper torso is also pivotally attached to a mid-section, which is further pivotally attached to a lower torso. The arms and legs of the posable toy are pivotally and/or rotatably attached to the upper torso and lower torso, via shoulder and hip joints, respectively. The posable toy also includes a motor coupled a pair of cams. When activated, one of the cams laterally rocks the upper torso while the other cam tilts the mid-section relative to the lower torso. Positioned within each joint are means for triggering responses to specific positions of the arms and legs. A PC board is coupled to the triggering means as well as a power source, the motor and a speaker unit. The PC board upon receiving responses from the triggering means controls the motor to produce movement through the cams to the upper torso and mid-section. Moreover, the PC board also produces sounds through the speaker unit indicative of the specific positions of the posable toy.

27 Claims, 11 Drawing Sheets

INTERACTIVE ROLE-PLAYING POSABLE TOY

FIELD OF THE INVENTION

This invention relates to toys, and more particularly to interactive posable toys programmed to emit electronic sounds and produce motions in response to specific body positions.

BACKGROUND OF THE INVENTION

Interactive posable toys have appeared for many years in a variety of forms, such as doll, toy figures, animal figures and fanciful characters, action figures and the such. Many of these toys produce various sophisticated sound effects such as simulated speech, music, animal and mechanical sounds. Generally, such devices require the use of some form of mechanical switch to stimulate the electronic production of sound. In most cases, the switch is mounted externally on the toy and must be literally turned on and off by the user. Other more sophisticated toys have been developed to incorporate the switch internally, and responsive to touch, such as petting or squeezing.

The more sophisticated toys, which incorporate internal mechanisms, also increase the level of interaction between the user and the toy. For instance, interactive toy babies may generate certain simulated speech such as laughing when squeezed, or crying until a bottle is placed in their mouth, and interactive toy animals may purr when petted or touched. However, these toys are still generally limited in their responses and level of interaction. For example, the ability for an interactive toy to role play different characters or produce various role playing response to various configurations of the toy is not known.

Often, when young children play, they imagine or pretend to be different characters, people, or things. For example, children will often extend their arms straight out from their bodies, pretending to be an airplane and generate sounds indicative of the same. Similarly, children may hold one of their hands straight up, pretending to be a police officer. As such, it would therefore be desirous to provide an interactive posable toy that when placed in certain positions or poses, emits responses indicative of the certain positions, such as an airplane, police officer, dog, race car driver, and etc.

SUMMARY OF THE INVENTION

In accordance with the present invention, there is provided an interactive posable toy that when moved in various positions, emits and produces responses by way of sounds and/or motions indicative of such positions. For example, when the toy is placed in a prone position with its legs and arms extended outwardly from the toy, the toy emits sounds indicative of a dog or cat. In a second example, when placed in an upright position with its legs and arms extended outwardly directly in front of the toy, the toy emits sounds indicative of being a racecar driver, bus driver, or cowboy. Moreover, specific positions of the toy may also trigger electronically controlled motions that further increase the role-playing characteristics of the interactive toy.

More specifically, the toy includes a head pivotally attached to an upper torso. The upper torso is also pivotally attached to a mid-section, which is further pivotally attached to a lower torso. The arms and legs of the toy are pivotally and/or rotatably attached to the upper torso and lower torso via shoulder joints and hip joints, respectively. The toy further includes a motor coupled to a pair of cams, which when activated, laterally rocks the upper torso and tilts the mid-section relative to the lower torso. Positioned within each joint are means for triggering electronic sounds and motions responsive to specific positions of the arms and legs. A PC board, coupled to the triggering means, a power source, the motor and a speaker unit, receives responses from the triggering means and controls the motor to produce motion through the cams to the upper torso and mid-section. Moreover, the PC board also produces sounds through the speaker unit indicative of the specific positions of the arms and legs.

In another embodiment of the invention the shoulder joints includes a second means of triggering sounds and motion when the arms are extended substantially perpendicular from the torso. In yet another embodiment of the invention a gravity switch is included in the mid-section to provide a means of triggering sounds and motion when the torso is in the prone and upright configuration.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
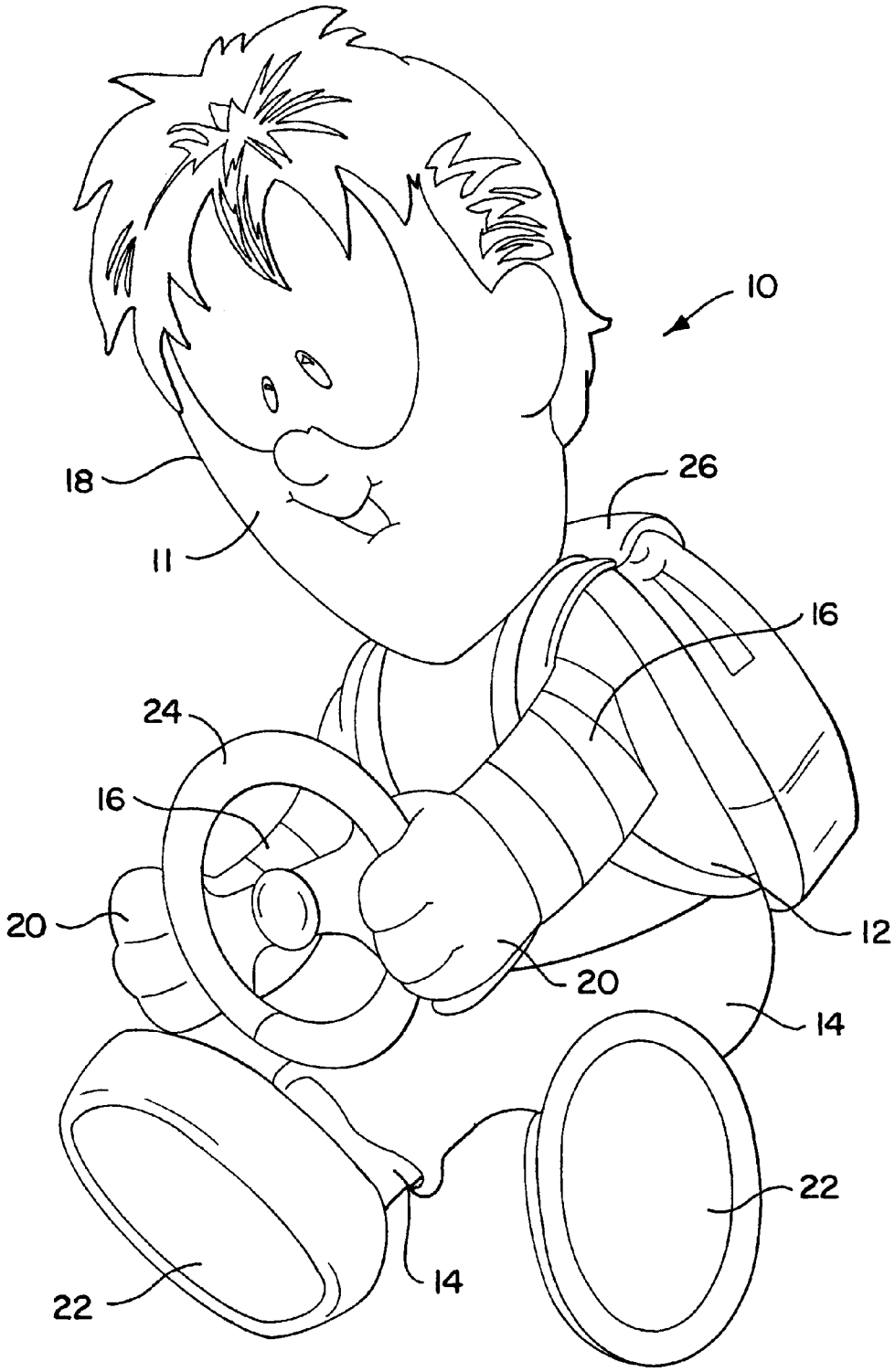
FIG. 1 is a perspective view of an interactive posable toy having a generic form of a child character.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring first to FIG. 1, a role playing interactive toy designated generally by numeral 10 is programmed to respond to various body configurations. The toy 10 has an external soft covering 11 placed over the inner rigid structures or skeleton, discussed in detail below. While the toy 10 is illustrated and discussed as a doll or child, the toy may be an interactive animal, insect or any type of fantasy character, without deviating from the spirit or scope of the invention. The toy 10 includes a torso 12, two legs 14, two arms 16 and a head 18, each pivotally and/or rotatably attached to the torso 12. The toy 10 further includes two hands and two feet 22 attached to the arms 16 and legs 14, respectively. Through a series of detents the legs 14, arms 16 and head 18 may be placed in numerous positions, discussed below in detail.

As illustrated in FIG. 1, the toy 10 is in a sitting position with the arms 16 extending outwardly from the torso 12. By positioning the toy 10 in this configuration, the toy emits electronic sounds and/or produces motions responsive to this configuration. The sounds may be any type of pre-recorded sound effects or voice/speech patterns, or may alternatively be capable of recording a user's voice or sound effects to be replayed when activated. When children role-play, this configuration is typically synonymous with driving a vehicle or being a race car driver. As such, the toy 10 when in this configuration, emits electronic sounds and/or produces motions responsive to pretending to be a race car driver, a bus driver or alternatively a cowboy. Additional costumes or accessories may be added to increase the attractiveness of each role-playing character, such as including a detachable steering wheel 24 positioned in between the two hands 20. Various other accessories or costumes may be held in a backpack 26 attached to the torso 12.

Moreover, while the interactive toy of the present invention produces sounds and motions in response to various positions of the arms 16, legs 14 and torso 12, the toy 10 may also respond to various movements of the head 18 or alternatively different accessories. By incorporating various responsive means in the head 18, hands 20, or feet 22 the toy 10 may respond differently to various hats, shoes, or other items. Such responsive means may be various electronic RF tags placed in different hats, such as a cowboy hat or firemen's hat, and a receiver placed on the head 18. When one of the hats is placed on the head 18, the toy 10 may emit sounds and produce motions indicative of the hat. Additionally multi-prong connectors placed on the hands 20, may permit the toy 10 to produce sounds and movement indicative of various items, such as a hammer, steering wheel or sword. Also, the incorporation of various responsive means in the feet 22 will permit the toy 10 to respond differently to different shoes, such as roller blades, snow skis, or a skate board.

Referring now to FIGS. 2A–2D, the toy 10 is illustrated with the external soft covering 11 removed and is generally referred to herein as a skeleton 27 of the toy 10. It is important to note that the external soft covering 11 is not essential to the invention and as such may be provided separately from the toy 10. The torso 12 includes an upper torso 30, a mid-section 40, two side sections 46 and a lower torso 50. Alternatively, the two side sections 46 may be integrally formed into the lower torso 50 forming a U-shaped section. The head 18 includes a speaker unit 28 that emits electronically stored sounds. A neck 29, protruding from the speaker unit 28, pivotally attaches the head 18 to the upper torso 30, also shown in FIG. 2D. The upper torso 30 also has two shoulder sockets 32, each for receiving a shoulder joint 34 that pivotally and rotatably attaches the arms 16 to the upper torso 30. The arms 16 include a forearm 36 attached to a flexible spring member 37. The flexible spring member 37 further attaches to the shoulder joint 34, and permits the arm 16 to bend and flex beyond the relative movement permitted by the shoulder joint 34. The upper torso 30 is also pivotally attached to the mid-section 40 about an upper torso axle 38. The upper torso axle 38 permits the upper torso to rock from one side to another side, illustrated in FIG. 2B.

Additionally, a circuit board, discussed in further detail below, is stored or housed in the upper torso 30. The circuit board contains various programming instructions and memory to store and control the sounds and motions of the interactive toy 10. When activated the programming instructions will send appropriate responses to the speaker 28 and various electronic motors (discussed below) that will cause the interactive toy 10 to imitate various role-playing characters.

Continuing to refer to FIG. 2A, the mid-section 40, which houses the motor, and gears, discussed in greater detail below, has a bottom portion 42 and an axle 44. The axle 44 pivotally attaches the mid-section 40 to the two side sections 46. The two side sections 46 are further attached to the lower torso 50. The lower torso 50 has a top portion 52 and a channel 54 formed therein. The channel 54 is sized accordingly to receive the bottom portion 42 of the mid-section 40. When the mid-section 40 tilts forwards or backwards about the axle 44, the bottom portion 42 of the mid-section 40 glides unobstructively above the lower torso 50 through the channel 54 illustrated in FIG. 2C.

Figure 2A:
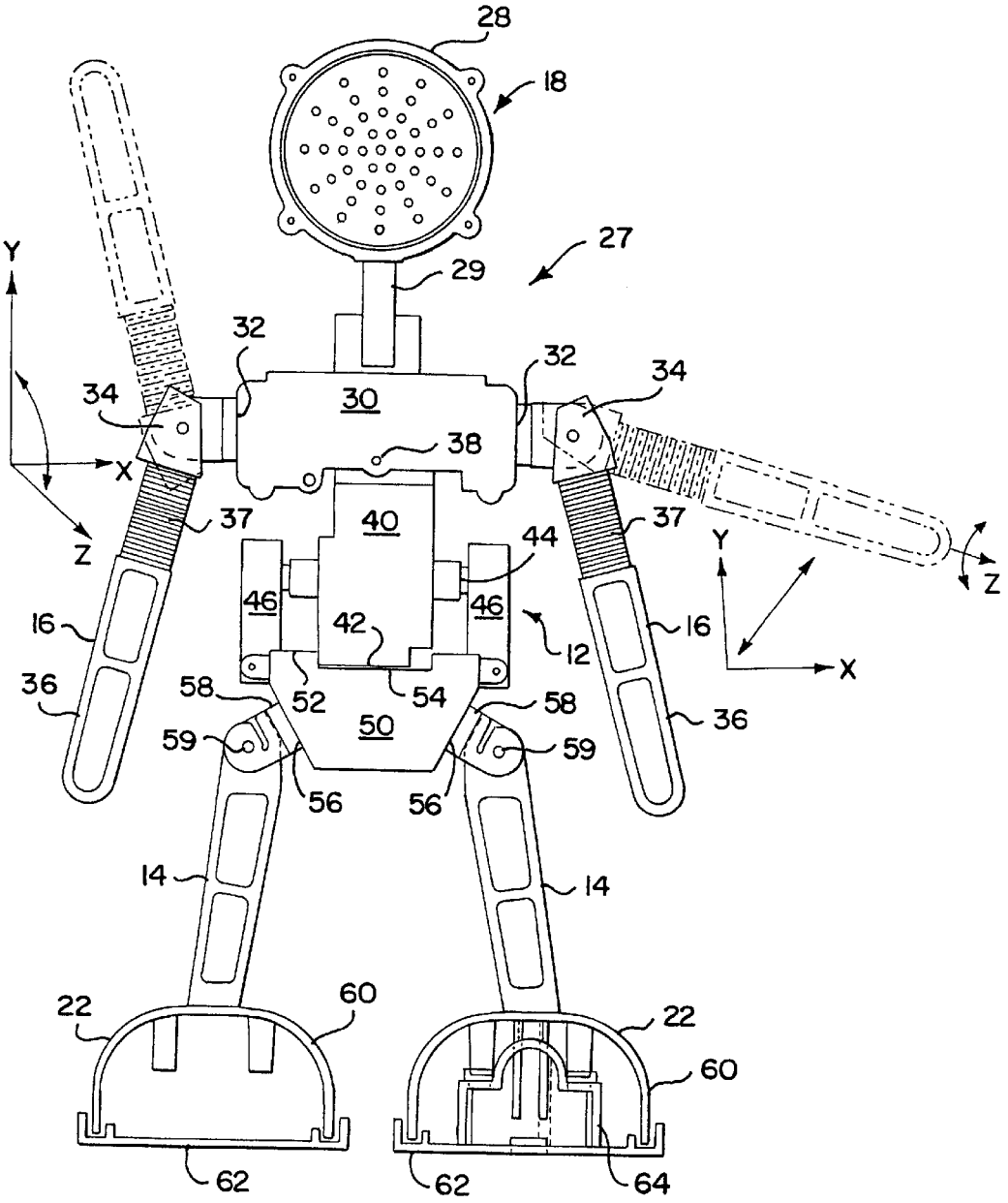
FIGS. 2A–2D are views showing the skeleton of the interactive posable toy and illustrating the range of motion of the interactive posable toy.
Figure 2B:
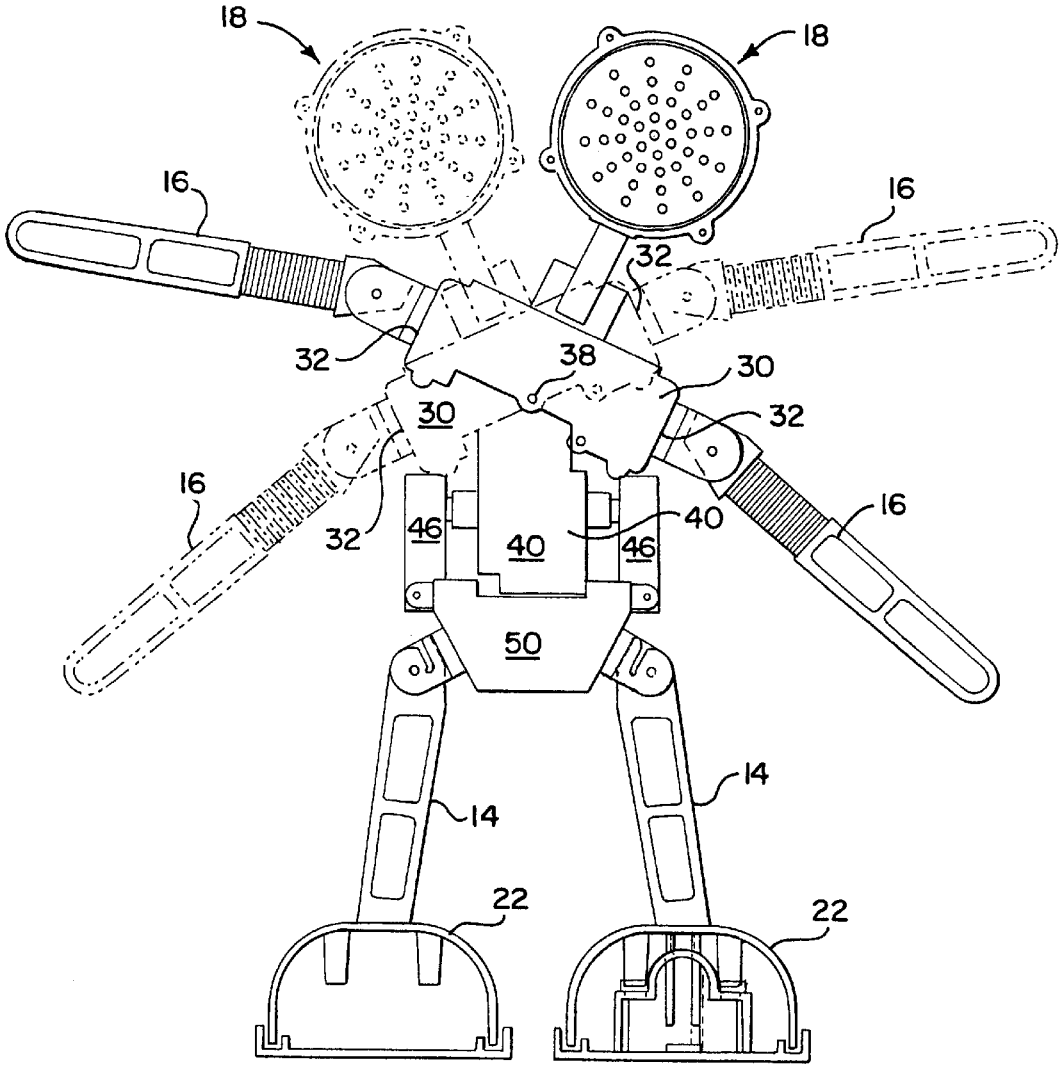

Referring to FIG. 2A, the lower torso 50 has two hip joint sockets 56 for receiving a hip joint 58. The legs 14 pivotally attach to the hip joints 58 via a leg joint 59. When attached the legs 14 may be rotated forwards and backwards relative to the lower torso 50 about the hip joint socket 56, illustrated in FIG. 2D, and pivoted outwardly about the leg joint 59. Each leg 14 further has a foot 22 attached thereto. The foot 22 includes a foot housing 60 removably attached to a foot base 62. Contained in one of the feet 22 is a power source enclosure 64, which houses a power source 65, such as a battery pack, best seen in FIG. 3. The power source 65 provides electric power to a motor, a circuit board and the speaker unit 28 discussed in greater detail below.

Figure 4:
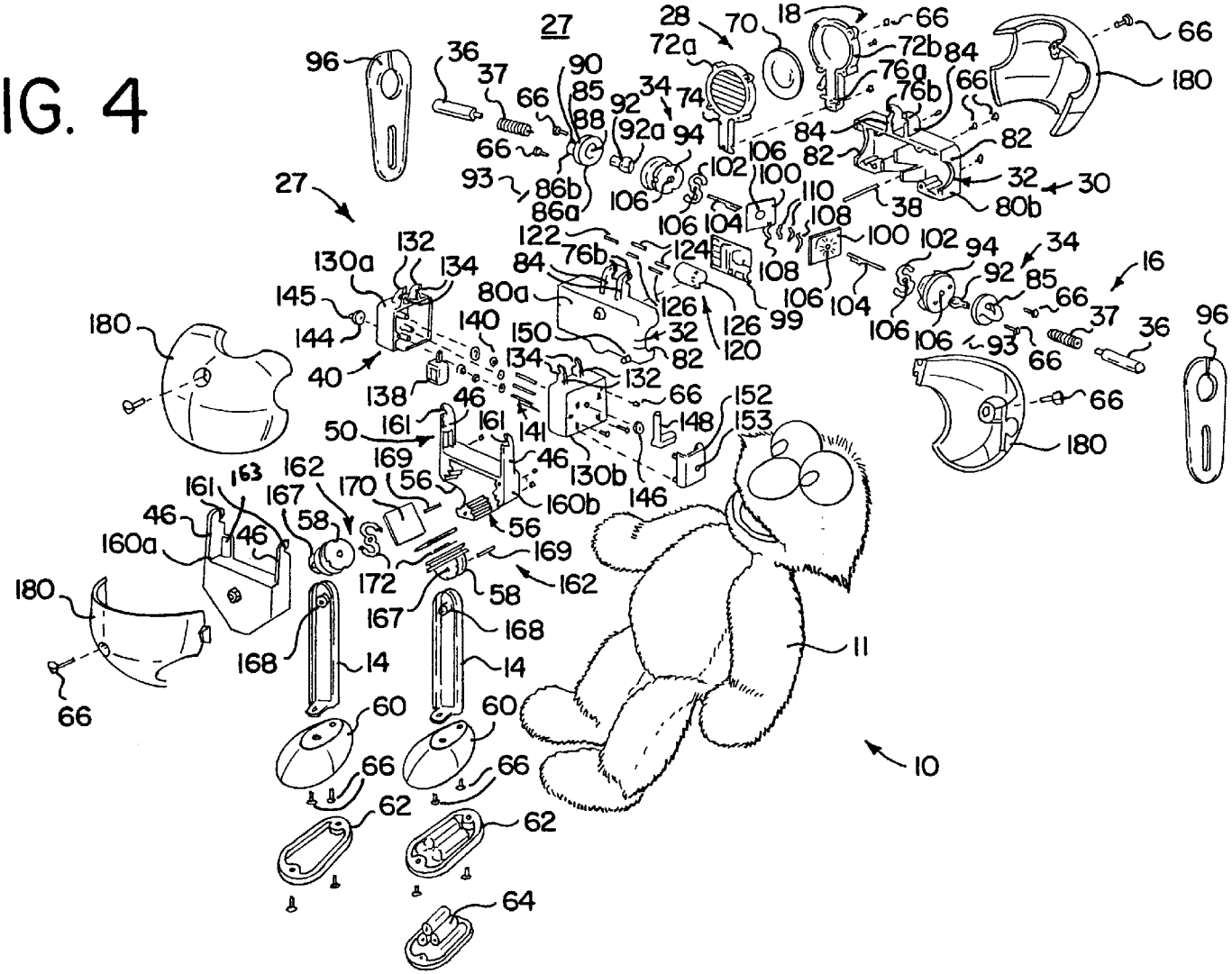
FIG. 4 is an exploded view of the interactive posable toy.

Referring now to FIG. 4, an exploded view of the toy 10 is illustrated. As indicated above, the toy 10 has an external soft covering 11. The design or character of the external soft covering may change in accordance to specific desired characters or as mentioned above, not included. The head 18 of the skeleton 27 consists of a speaker unit 28, defined by a speaker 70 contained within a front speaker housing **72*a* and a rear speaker housing 72*b*. The front and rear speaker housings 72*a* and 72*b*, respectively, are fixedly attached to each other by screws 66, or any other securing means well known in the art. As illustrated, a protruding neck member 74 is integrally molded into the front and rear speaker housings 72*a* and 72*b*, respectively. When assembled, the protruding neck members 74 combine to form the neck 29. The protruding neck member 74 in the rear speaker housing 72*b* has a pair of opposing pins 76*a*, which pivotally attaches the head 18 to the upper torso 30**, discussed in further detail below.

A front and rear upper torso, **80*a* and 80*b* respectively, define the upper torso 30, which interconnect and are rigidly attached to each other by screws 66. The front and rear upper torsos 80*a* and 80*b* have notches 82, which form the shoulder sockets 32 when the front and rear upper torsos 80*a* and 80*b* are assembled together. The front and rear upper torsos 80*a* and 80*b*also have a pair of extending members 84. Each extending member 84 has a notch 76***b*, which when the upper torso 30 is assembled, combine to receive the pair of opposing pins 76*a* in the neck 29. The notches 76*b* when combined also form detents (not shown) that support the head 18 in a specific position but also does not prevent the head 18 from being pivoted to another position.

Figure 5:
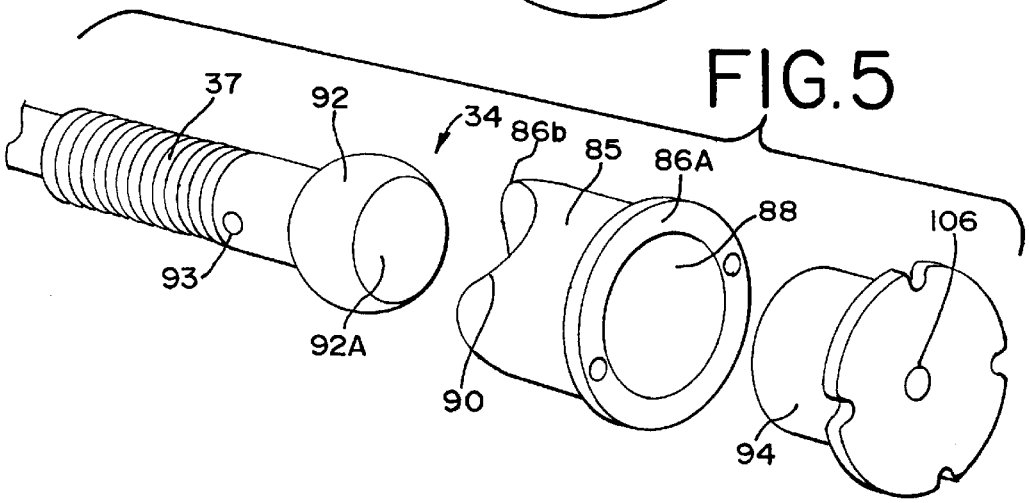
FIG. 5 is an exploded view of the shoulder joint.

The shoulder sockets 32 are sized accordingly to receive a shoulder joint 34, also illustrated in FIG. 5. The shoulder joint 34 includes a ball joint housing 85 and a ball joint 92. The ball joint housing 85, also shown in greater detail in FIGS. 10A–10D, is dome shaped with a circular bore 88 extending from the base 86*a* (surface facing the shoulder socket 32) to the peak 86*b* (surface facing away from the shoulder socket 32). The ball joint housing 85 also has a slot 90, which extends along a side of the ball joint housing 85 from the base 86*a* to the peak 86*b*. A portion 91 of the slot 90 at the peak 86*b* is eccentric such that the arm 16 is positioned away from the horizontal, or slightly less then 90° from the upper torso 30. When assembled the ball joint 92 is received and contained within the ball joint housing 85. Discussed in greater detail below, this eccentric portion 91 in combination with the ball joint 92 and the shoulder joint housing 94 prevents the arm 16 from breaking away from the shoulder socket 32.

The ball joint 92, which has a flat area 92*a*, is inserted through the base 86*a* of the ball joint housing 85 and is fixedly attached to one end of the flexible spring member 37 by an arm joint 93, which permits the flexible spring member 37 to pivot. Referring now to FIG. 4 the arm 16 is defined by attaching the other end of the flexible spring member 37 to the forearm 36. The assembled shoulder joint 34 attaches to a shoulder joint housing 94, which is received and rotatably attached to the shoulder socket 32 in the upper torso 30. Additionally, a guard 96 may fit over the arm 16 and secure to the upper torso 30 protecting the internal mechanisms and the shoulder joint 34.

Referring to FIG. 2A, when the shoulder joint 34 is assembled, the ball joint 92 may turn within the ball joint housing 85 such that the arm 16 may turn about a Z-axis. The slot 90 also permits the arm 16 to move in an X-Y direction. Lastly, the shoulder joint housing 94 which rotates 360° within shoulder socket 32 also rotates the shoulder joint 34 360° in the Y-Z plane. As mentioned above, the combination of the shoulder joint 34, the shoulder joint housing 94 and the shape of the slot 90 prevents the arm 16 from being forced out of the shoulder socket 32, or broken or snapped out of its shoulder socket 32.

When a force is applied against the arm 16 such that the arm 16 is being extended horizontal (along the slot 90 towards the peak 86*b* of the ball joint housing 85), the ball joint 92 moves the arm 16 into the eccentric portion 91 of the ball joint housing 85. The eccentric portion 91 being off center from the peak 86*b* of the ball joint housing 85 causes the force being applied to the arm to be redirected off center. In turn the shoulder joint housing 94, which is attached to the ball joint housing 85, will begin to rotate within the shoulder joint 32. As the shoulder joint housing 94 rotates, the ball joint housing 85 also rotates. This causes the direction of the force to continue to rotate until the slot 90 moves in front of the direction of the force, causing the arm 16 to slide back through the slot 90 (towards the base 86*a*). Once the arm 16 moves towards the base 86*a* the force will no longer be forcing the arm 16 out of the shoulder socket 32. Thus the combination of the ball joint 92, the ball joint housing 85, the should joint housing 94 and the shoulder joint 32, impedes the ability to bend or break the arm 16 out of its shoulder socket 32.

As mentioned above, when positioned in various configurations the toy 10 emits sounds and produces motions responsive to the specific configurations. To facilitate the responsive sounds and motions, the arms 16 and legs 14 have means for triggering the electronics when pivoted to specific positions. These response triggering means are positioned in the joints of the arms 16 and legs 14. Continuing to refer to FIG. 4, the response triggering means positioned in each shoulder joint 34 includes an arm wiper board 100 in communication with an arm brush contact 102. The arm wiper board 100 is secured in the upper torso 30, while the arm brush contact 102 is secured to the shoulder joint housing 94. When the shoulder joint housing 94 rotates, the arm brush contact 102 rotates and touches various contacts on the arm wiper board 100. If the arms 16 are rotated to a specific position, preferably pre-defined by detents in the shoulder socket, such as in FIG. 1, the arm brush contacts 102 remain in contact with specific contacts on the arm wiper boards 100. A PC board 99, in communication with the arm wiper boards 100, receives signals from the wiper boards indicating the specific positions in the arms 16 and will trigger responsive sounds and motion in the interactive posable toy 10, as long as other arm and leg positions and relative contacts are made.

Figure 6:
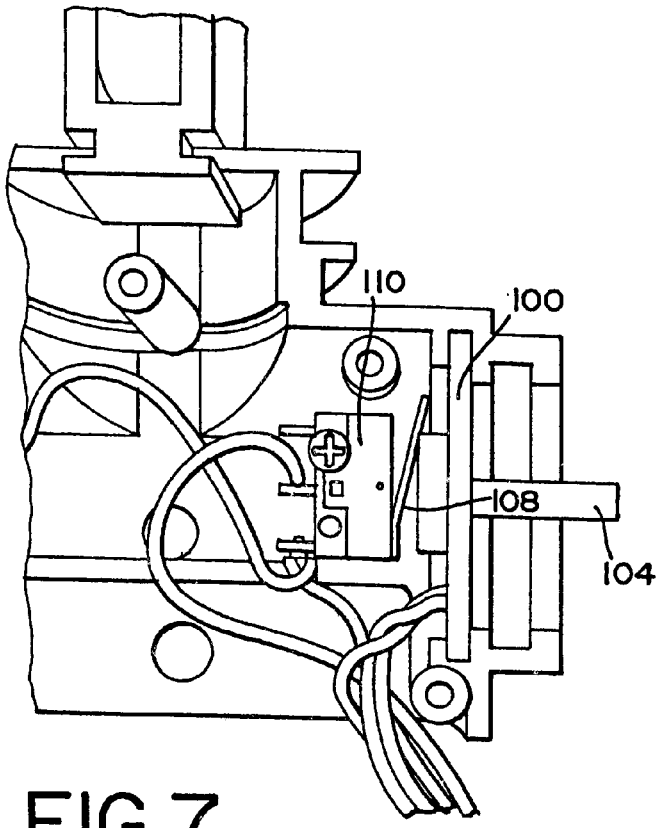
FIG. 6 is a top view of a second means for triggering electronic sounds and motions positioned in the shoulder socket.

In order to trigger sounds and motion responsive to when the arms 16 are extending outward, such as when pretending to be an airplane, a second response triggering means is positioned in each shoulder joint 34. The second response triggering means in each shoulder joint 34 includes a rod 104, a spring 108, and a switch 110. In reference to FIGS. 4 and 6, when the second response generating means is assembled, the rod 104 extends through apertures 106 in the arm wiper board 100, brush contact 102 and the shoulder joint housing 94. The spring 108 biases the rod 104 outwardly from the center of the upper torso 30. When the arm 16 extends outwardly, the flat area 92*a* of the ball joint 92 allows the rod 104 to be pushed away from the switch 110 by the biasing of the spring 108, thus opening the switch 110. The position of the switch, open and closed, is communicated to the PC board 99. The PC board 99 recognizing the open or closed position of the switch 110 triggers electronic sounds and motions, as long as the other respective contacts in the toy 10 are made. When the arm 16 extends downwardly, the spherical area of the ball joint 92 moves into contact with the rod 104, which is moved toward the center of the torso 30 compressing the spring 108 and closing the switch 110.

In accordance with the present invention, the toy 10 will emit responsive sounds and produce motions when the torso 12 is placed in an upright configuration and alternatively in a horizontal configuration. To facilitate these responses, the upper torso 30 includes a gravity switch 120. When the upper torso 30 is in the upright configuration a roller contact 122, housed within the gravity switch 120, makes contact with a first set of specific contacts 124. This is communicated to the PC board 99, which recognizes that the upper torso 30 is in the upright configuration. Similarly, when the upper torso 30 is horizontal, the roller contact 122 moves and makes contact with a second set of contacts 126. When this is communicated to the PC board 99, the PC board 99 recognizes that the upper torso 30 is in the horizontal configuration.

Continuing to refer to FIG. 4, the mid-section 40 is formed by securing a left mid-section housing 130*a* to a right mid-section housing 130*b*. Each mid-section housing includes a pair of extending members 132, each having a notch, which when assembled combine to form a pair of openings 134. The pair of openings 134 receives the upper torso axle 38, which is also rigidly connected to the front and rear upper torso housing 80*a* and 80*b*, respectively. The pair of openings 134 engages the upper torso axle 38, such that the upper torso 30 may rock about the upper torso axle 38, while being maintained in any given position.

As mentioned above, the mid-section 40 houses a motor 138, which transfers torque to gear mechanisms 140 through axles 141. The motor 138 is utilized to provide the rocking movement of the upper torso 30, illustrated in FIG. 2B, and the tilting movement of the mid-section 40, illustrated in FIG. 2C. The rocking movement is accomplished by translating the torque from the motor 138 to a right cam 146. The right cam 146 is attached to a lift mechanism 148, which connects to a protrusion 150 on the front upper torso housing 80*a*. When the right cam 146 is rotated, the rotational movement laterally moves the lift mechanism 148. Since the lift mechanism 148 is attached to the upper torso 30, the upper torso 30 rocks to the left and right when the lift mechanism 148 laterally moves. The lift mechanism 148 is enclosed in a left housing 152, which secures to the right mid-section 130*b*. The motor 138 also translates movement to a left cam 144, which interfaces with a channel 163 located on the left side section 46, via a pin 145. As such, when the motor 138 rotates the left cam 144, the mid-section 40 tilts forwards and backwards relative to the lower torso 50. While not shown, the PC-board 99 includes programming to control the speed and direction of the motor 138 in response to various positions of the arm 16 and legs 14. Through variable gear ratios in the gear mechanism 140, or cam sizes the motor 138 may rotate the left cam 144 and the right cam 146 at two different rates or at the same rates but depending upon the gear ratios or cam sizes the motion of the posable toy may rock and tilt at the same or different rates.

Figure 2D:
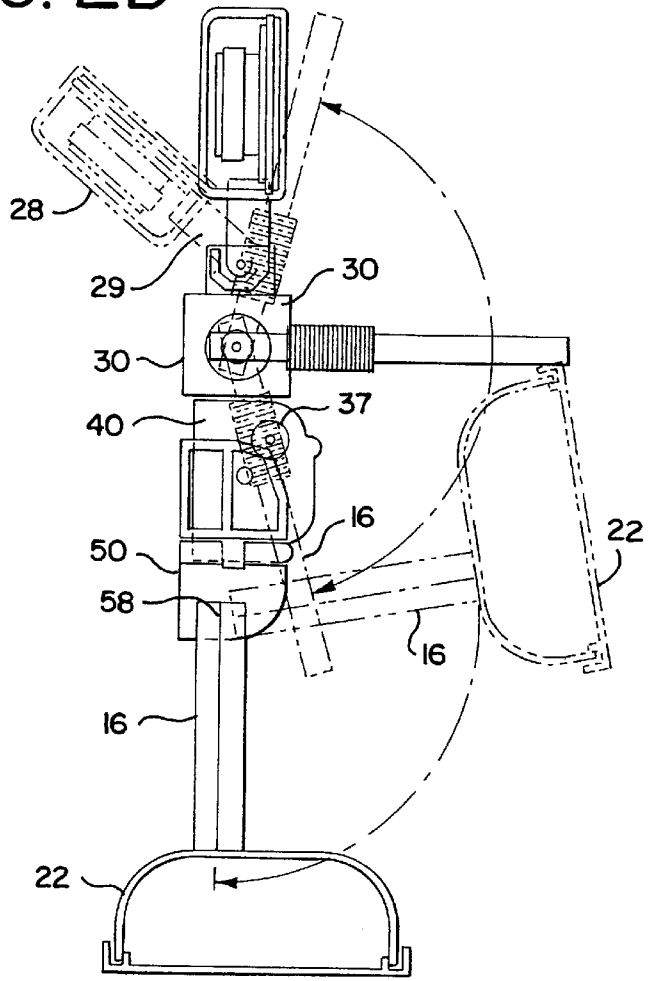
Figure 2C:
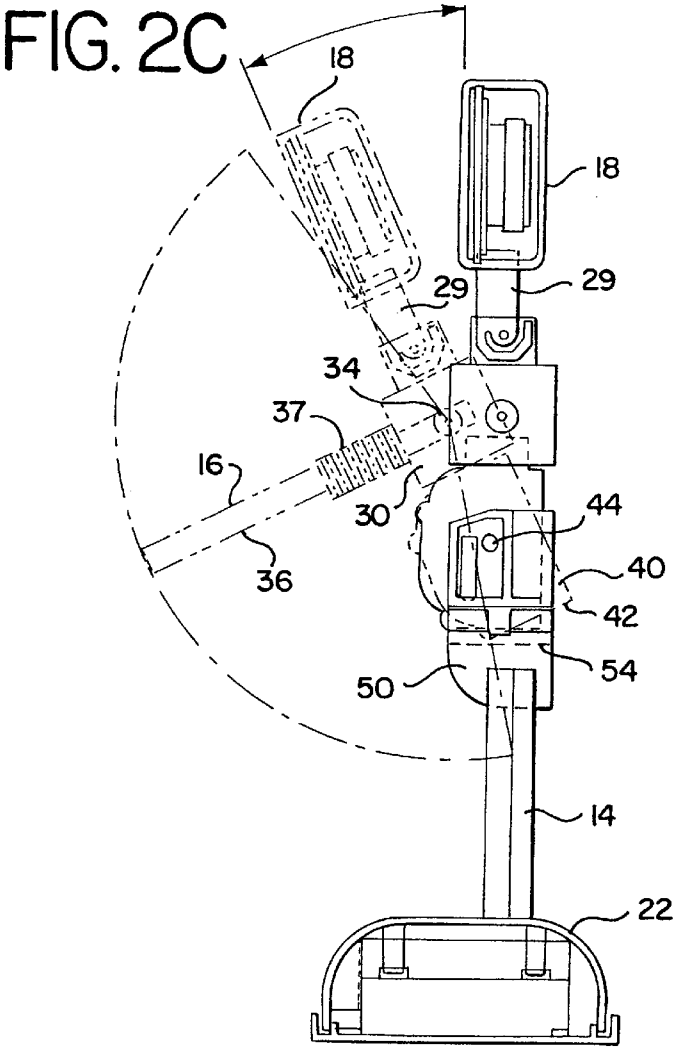
Figure 3:
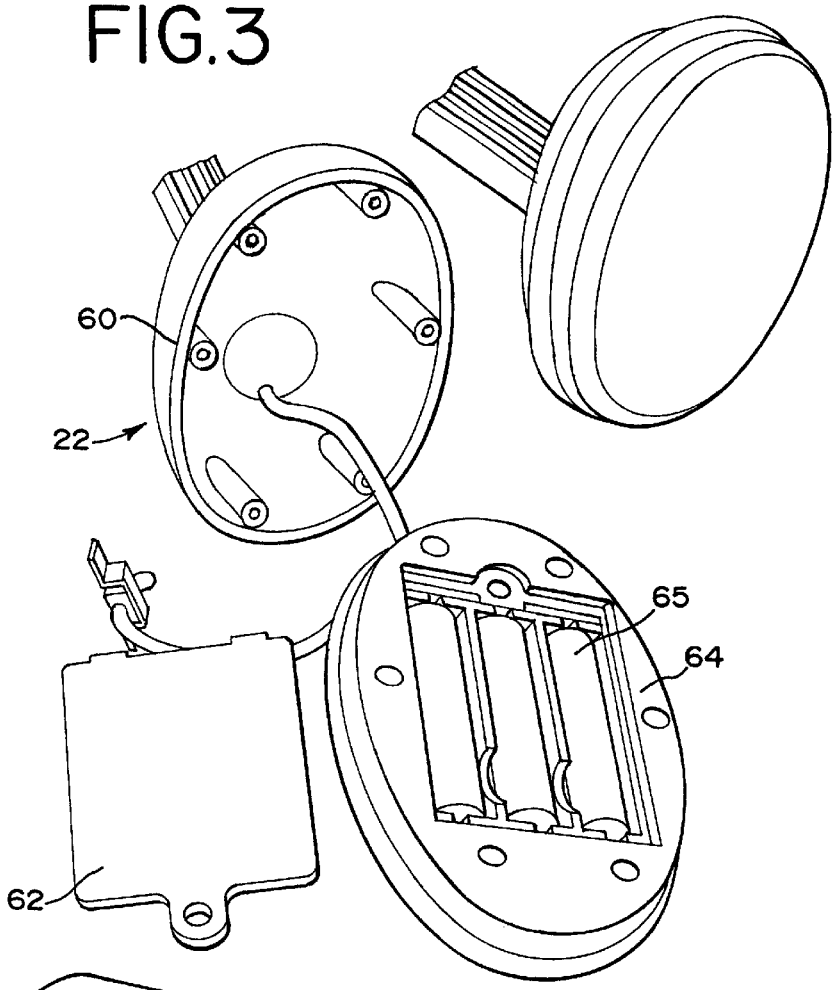
FIG. 3 is a partially exploded view of a foot.
Figure 7:
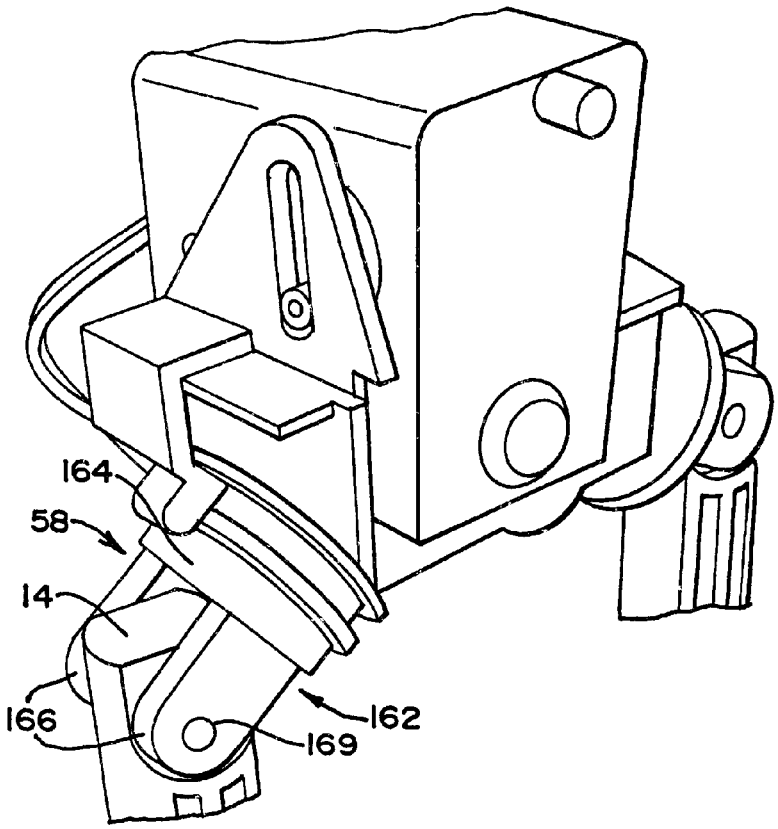
FIG. 7 is a perspective view of the hip joint and the leg joint.

Continuing to refer to FIG. 4, the lower torso 50 is defined by a front and rear lower torso housings 160*a* and 160*b* respectively. Each lower torso housing includes side sections 46, which are integrally formed in the lower torso 50. When assembled, the side sections 46 form openings 161 that secure to a pin (not shown) on the left mid section 130*a* and a pin 153 on the left housing 152. In addition, when assembled the lower torso 50 forms the hip joint sockets 56, which house the hip joints 58. The hip joints 58, best seen in FIG. 7, is a U-shaped joint 162, with a circular base 164, and two members 166. The two members 166 have openings 167 (shown in FIG. 4), which align with an aperture 168 on each leg 14. A leg joint 169, inserted through the openings 167 and the aperture 168, secures the leg 14 to the hip joint 58. The circular base 164 rotatably attaches the hip joint 58 to the hip joint socket 56, which permits the leg 14 to move forward and backward, as illustrated in FIG. 2D. Referring now to FIG. 4, the legs 14 as mentioned above, connect to the foot housing 60 by screws 66. The foot housing 60 further connects to the foot base 62. Moreover, one of the feet 22 houses the power source 64. The power source is connected to the PC board 99 electric via electric wires, not shown. The circuit board then distributes the power to the motor and speaker to produce the motions and emit the sounds triggered by the triggering means.

To facilitate the responsive sounds and motions caused by the configuration of the legs 14, response triggering means are also positioned on the circular bases 164 of each hip joint 58 and in the hip joint sockets 56 of the lower torso 50. A pair of leg wiper boards 170, similarly configured to the arm wiper boards 100, is secured in the lower torso 50 and is in communication with a leg contact brush 172, secured to the circular base 164. When the leg 14 is moved, the leg contact brush 172 rotates and touches various contacts on the leg wiper board 170. When the legs 14 remain in a specific position, preferably identified by detents in the hip joint socket 56, such as illustrated in FIG. 1, and the arms 16 are also in position, the arm contact brushes 102 and the leg contact brushes 172 communicate with specific contacts on the arm wiper boards 100 and the leg wiper boards 170, respectively. Moreover, when specific contacts or circuits within the gravity switch 1are also activated, in either the prone or upright configuration, the PC board 99 will produce various sounds and motions, which are responsive to the specific positions of the torso 30, the arm 16 and the legs 14. The toy 10 further includes four coverings 180 that protect the torso 12 and provide support for the soft exterior covering 11.

Figure 10B:
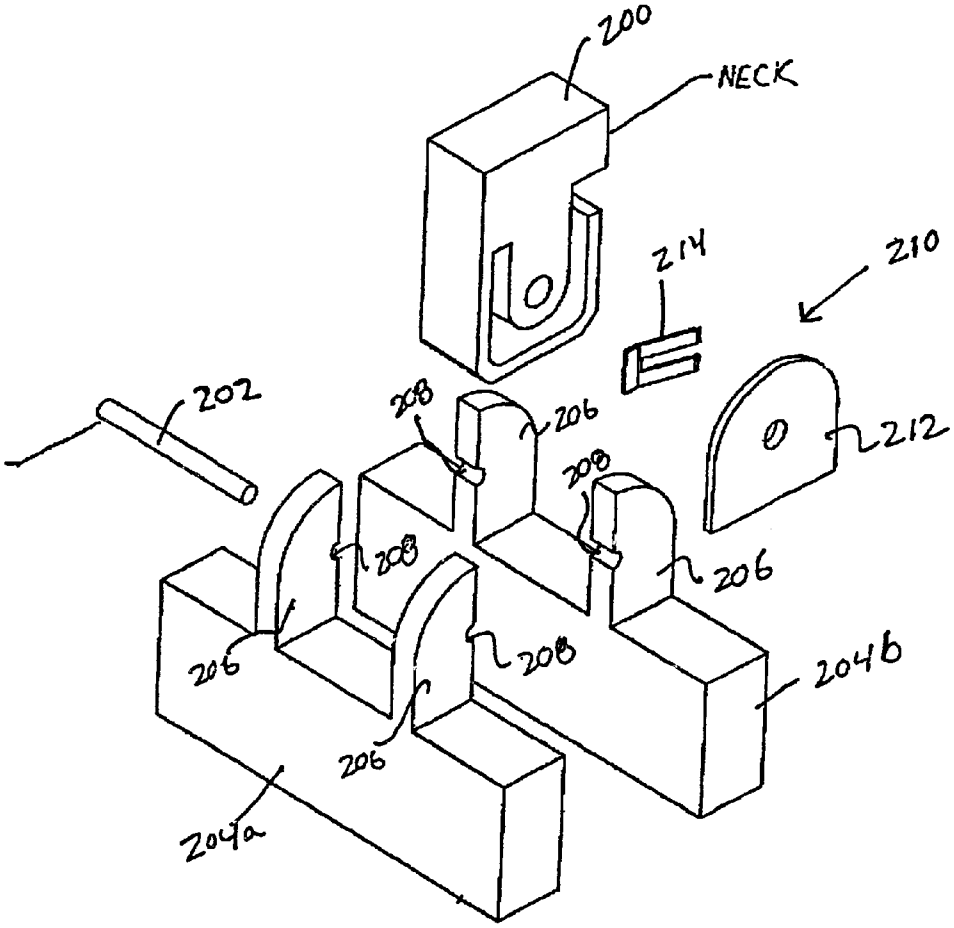
FIG. 10B is an exploded view of the neck joint shown in FIG. 10*a*.
Figure 10A:
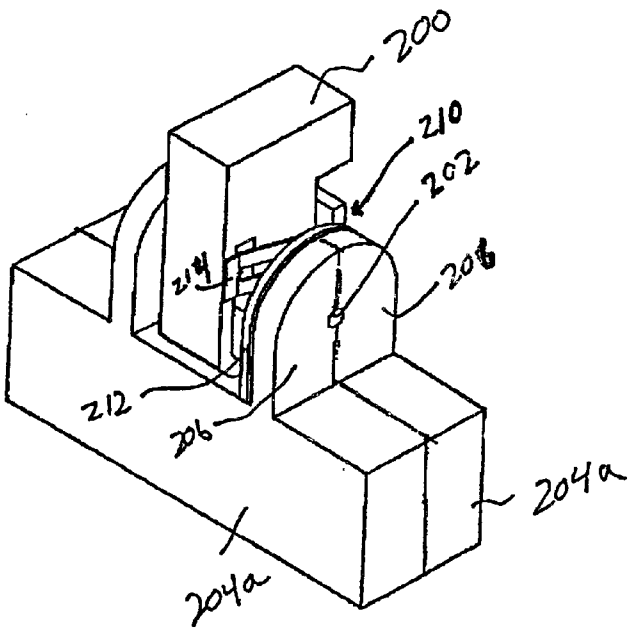
FIG. 10A is a perspective view of the neck joint of an other embodiment of the present invention.

In another embodiment of the present invention additional triggering means, as described above, may be positioned in the neck. Referring now to FIG. 10A and 10B, a neck 200, which is attached to the head of an interactive toy in accordance with the present invention (not shown), is pivotally attached to the upper torso by a pivot pin 202. The upper torso, as described above, is defined by a front and rear upper torso 204*a* and 204*b*, respectively. The front and rear upper torsos 204*a* and 204*b* have a pair of extending members 206, which are sufficiently spaced apart to receive the neck 200. Each of the extending members 206 includes a notch 208, which when the upper torso is assembled form openings that receive the pivot pin 202. A neck triggering means 210 may then be placed in between the neck 200 and the upper torso, shown in FIG. 10A. Similarly configured to triggering means in the arms and the legs, as described above, the neck triggering means 210 includes a wiper board 212 in communication with a brush contact 214. When the neck 200 is positioned to a specific position, the brush contact 214 remains in contact with specific contacts on the wiper board 212. The PC board 99, also in communication with the wiper board 212, recognizes the specific position in the neck 200 and will trigger responsive sounds and/or motion in the interactive posable toy 10.

Figure 8C:
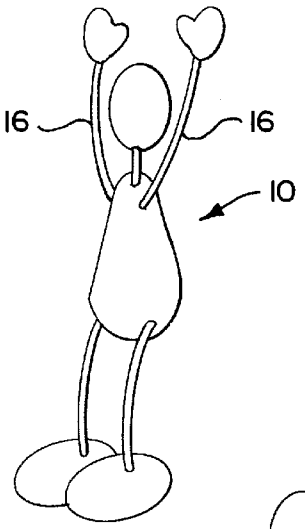
FIGS. 8A–8F are perspective views of a schematic illustration of various configurations that may be utilized for triggering different role playing characters of the interactive posable toy of the present invention.
Figure 8B:
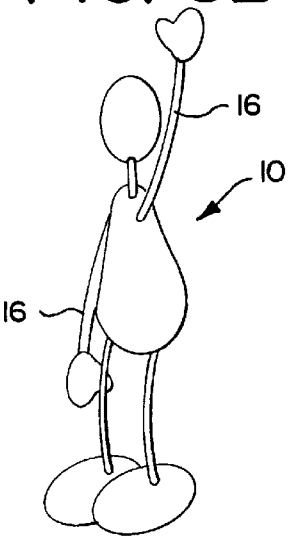
Figure 8A:
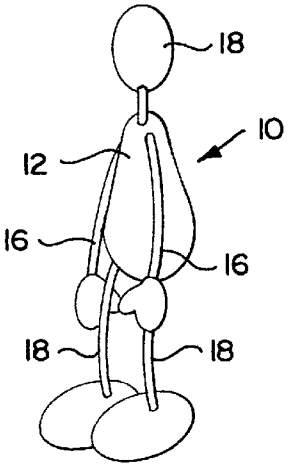
Figure 8F:
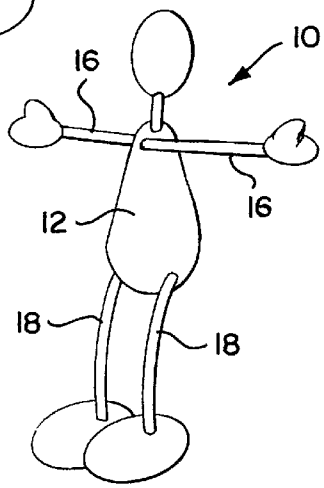
Figure 8E:
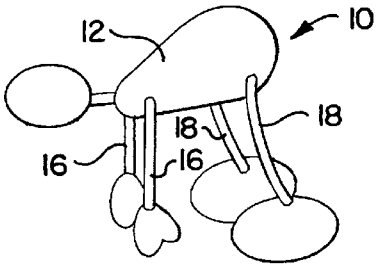
Figure 8D:
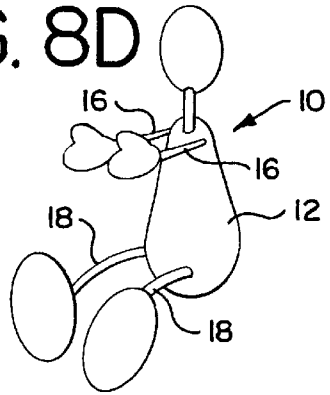
Figure 9B:
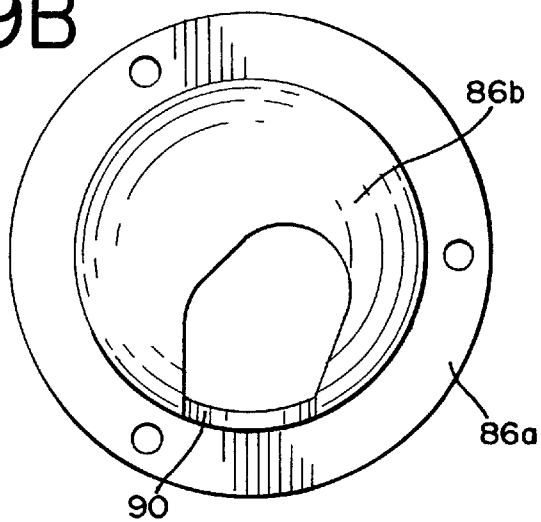
FIGS. 9A–9D are perspective views of the shoulder joint housing.
Figure 9D:
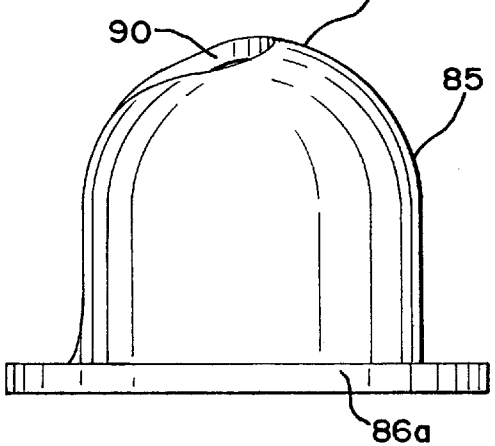
Figure 9A:
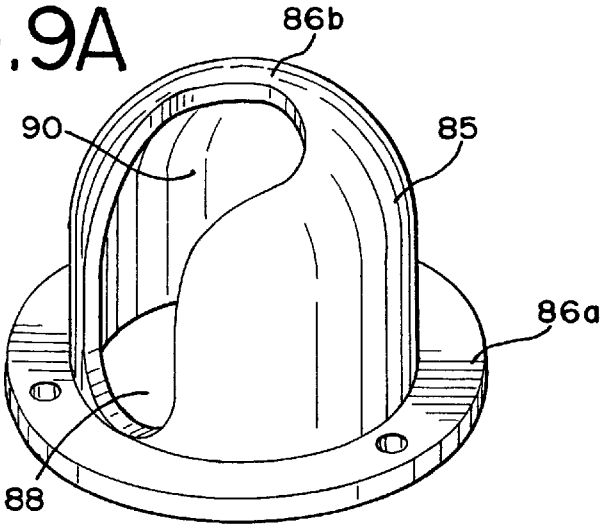
Figure 9C:
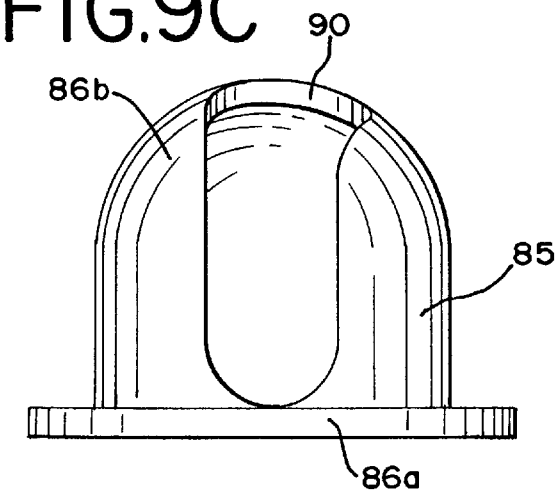

Generally illustrated in FIGS. 8A–8F, the toy 10 in accordance with the present invention is illustrated in six different configurations. In FIGS. 8A–8C, the toy 10 is in a standing configuration with the arms 16 positioned in various configurations. In FIG. 8A, the toy 10 provides an introduction phrase, prompting a user to position the toy 10 in another configuration. In FIG. 8B the toy 10, having one of the arms 16 positioned upwardly and the torso 12 in the upright configuration, emits vocal sounds and/or motions responsive to being a police officer or a train conductor. Various accessories, for instance a police cap or train conductor's hat may be provided to increase the role-playing characteristics of the toy 10. In FIG. 8C the toy 10, having both arms 16 extended upwardly and having the torso 12 in the upright configuration, emits sounds and/or produces motions responsive to being a monster. In FIG. 8D, the toy 10 is illustrated in a sitting configuration with its arms 16 extending outwardly from the torso 12 and the torso 12 is in an upright configuration, similarly illustrated in FIG. 1. In this seated configuration, the toy 10 emits sounds and/or produces motions responsive to being a racecar driver or cowboy. Referring now to FIGS. 8E and 8F the torso 12 has been positioned in a horizontal or prone configuration with the arms 16 and legs 14 moved to different positions. In FIG. 8E, the arms 16 and legs 18 are positioned is the same configuration as illustrated in FIG. 8D, however, the torso 12 is in a prone configuration. In this configuration, the configuration of the toy 10 is synonymous with an animal, such as a dog or cat. In FIG. 8F, the arms 16 are extending outwardly from the torso 12. In this configuration, the toy 10 emits sounds and/or generates sounds responsive to being an airplane or to imitate Superman®. By positioning the torso 12, legs 14, arms 16, head 18, hands 20 and feet 22, in separate and distinct positions it is contemplated by the present invention that the toy 10 may be positioned in numerous additional configurations.

In an alternate embodiment of the present invention, the hand 20 may include a sensor or switch that triggers a sound when squeezed, such as "HELLO" or another greeting. In yet another alternate embodiment of the present invention, the interactive toy 10 may include a replay switch which when depressed triggers to the PC board 99 to replay the same sounds or play sounds indicative of the configuration but in reference to a different role. For instance, when in a configuration as shown in FIG. 8E, the toy 10 may produce sounds synonymous with a cat. Afterwards, if the replay switch is depressed the toy may produce sounds synonymous with a dog. The interactive posable toy may further replay pre-programmed responses or motions which are not triggered by positions but which may be triggered by inactivity of the toy, which prompt the user to initiate, cease or continue play. For instance, if the user after playing the toy for a period of time, leaves the toy for a specified period of time in the position indicative of the dog or cat, the toy may emit sounds enticing the user to continue playing, such as playing "LETS PRETEND TO BE A COWBOY" or may play "IT WAS NICE PRETENDING WITH YOU LETS PLAY AGAIN SOON."

Figure 11A:
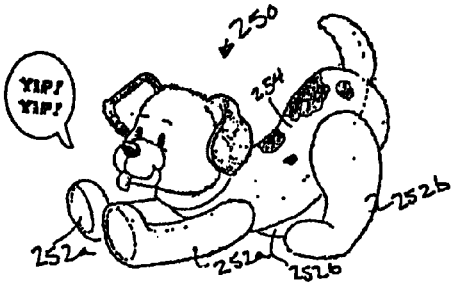
FIGS. 11 A–11I are perspective views of an other embodiment of the interactive posable toy having a generic form of a puppy and shown in various configurations that may be utilized for triggering different sound and motion responses.
Figure 11B:
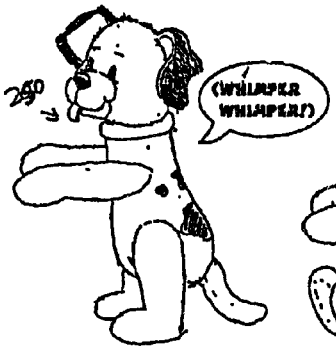
Figure 11C:
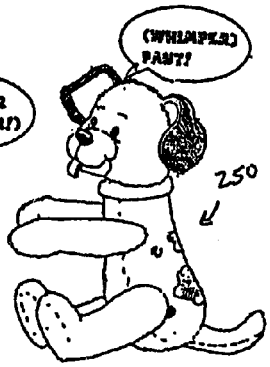
Figure 11D:
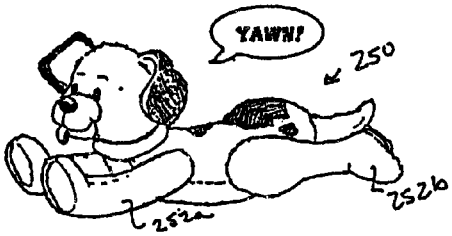
Figure 11E:
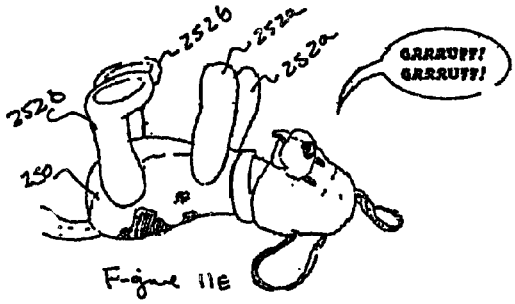
Figure 11F:
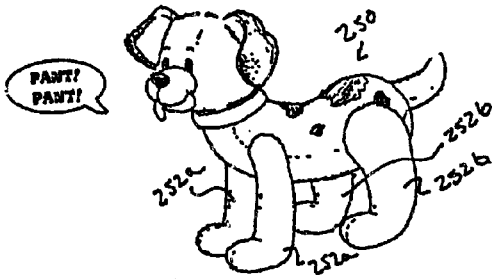
Figure 11G:
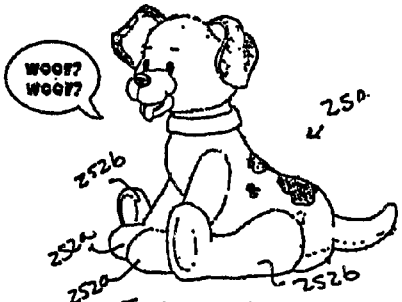
Figure 11H:
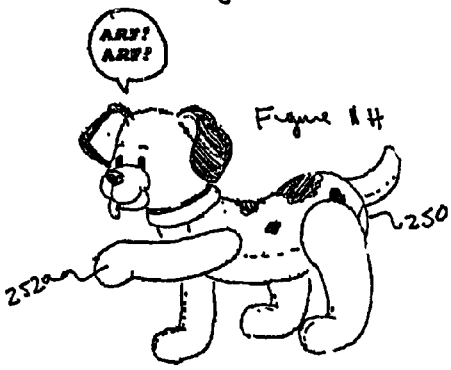
Figure 11I:
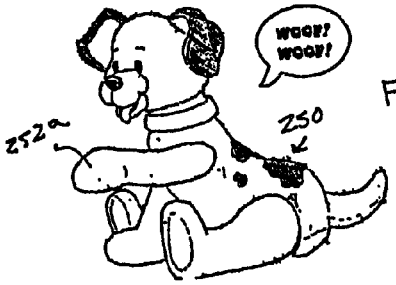

As mentioned above, the interactive posable toy may be various animals, insects, or fantasy characters. As such and in accordance with the present invention, reference is made to FIGS. 11A–11I, where the interactive posable toy is a puppy 250. The puppy 250 has two front legs 252*a* and two rear legs 252*b*, which are pivotally and or rotatably attached to a torso 254. As seen in FIG. 11A, the front legs 252 are out and the back end is up causing the puppy to emit a YIP! YIP! sound. However, as seen in the other illustrations, when the legs 252 and the configuration of the torso 254 is moved, the puppy 250 emits different sounds, indicative of the configurations. For example, in FIG. 11B the puppy 250 is in a standing begging position emitting a whimpering sound. In FIG. 11C, the puppy 250 is in a sitting beginning position emitting a whimpering painting sound. In FIG. 11D, the puppy 250 is lying on the ground with its legs 252*a* and 252*b* extending out, causing the sound emitting means to provide a yawn. In FIG. 11E the puppy 250 is lying on its back with its legs 252*a* and 252*b* up, indicative of a playful position. In FIG. 11F the puppy 250 is on all its four legs 252*a* and 252*b*, panting. In FIG. 11G the puppy 250 is sitting with both front legs 252*a* on the ground. In FIG. 11H, the puppy 250 is in a standing pose emitting a barking noise and in FIG. 11I the puppy 250 is sitting with one it its front legs 252*a* up emitting a barking noise.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. An interactive posable toy comprising:

an upper torso having two shoulder sockets for receiving two arms;

a mid-section pivotally attached to the upper torso;

a lower torso pivotally attached to the mid-section, the lower torso having two hip sockets for receiving two legs;

a head pivotally attached to the upper torso;

two shoulder joints pivotally and rotatably attach the two arms separately, to one of the shoulder sockets, each shoulder joint including, a ball joint housing and a ball joint, the shoulder joint being rotatably attached to the shoulder socket such that the shoulder joint may rotate within the shoulder socket, the ball joint housing having a slot and being fixedly attached to the shoulder joint, the ball joint having a flat area and rotatably positioned in the ball joint housing such that the ball joint may turn within the ball joint housing, the ball joint further pivotally attached to the arm, whereby the shoulder joint permits the arm to turn, rotate and pivot in relation to the shoulder socket;

two hip joints pivotally attach the two legs to one of the hip sockets separately;

a means for emitting sounds responsive to specific positions of the arms and legs; and a first means for triggering said sound emitting means, said first triggering means located in the arms and legs, wherein when the arms and legs of the posable toy are positioned in said specific positions, the first triggering means triggers the sound emitting means to emit sounds indicative of said specific positions of the arms and legs.

2. The interactive posable toy of claim 1 further comprising:

a means for producing motion responsive to specific positions of the arms and legs, wherein when the arms and legs of the posable toy are positioned in said specific positions, the first triggering means further triggers the motion producing means to produce motion indicative of said specific positions of the arms and legs.

3. The interactive posable toy of claim 2 further comprising:

a second means for triggering the sound emitting means and the motion producing means when the position of the posable toy is in a prone position and an upright position.

4. The interactive posable toy of claim 3 further comprising:

a third means for triggering the sound emitting means and the motion producing means when the arms are extended to a substantially horizontal position.

5. The interactive posable toy of claim 4 further comprising:

a fourth means for triggering the sound emitting means and the motion producing means when the head is positioned in a specific position.

6. An interactive posable toy comprising:

an upper torso having two shoulder sockets for receiving two arms;

a mid-section pivotally attached to the upper torso;

a lower torso pivotally attached to the mid-section, the lower torso having two hip sockets for receiving two legs;

a head pivotally attached to the upper torso;

two shoulder joints pivotally and rotatably attach the two arms separately, to one of the shoulder sockets, each shoulder joint including, a ball joint housing and a ball joint, the shoulder joint being rotatably attached to the shoulder socket such that the shoulder joint may rotate within the shoulder socket, the ball joint housing having a slot and being fixedly attached to the shoulder joint, the ball joint having a flat area and rotatably positioned in the ball joint housing such that the ball joint may turn within the ball joint housing, the ball joint further pivotally attached to the arm, whereby the shoulder joint permits the arm to turn, rotate and pivot in relation to the shoulder socket;

two hip joints pivotally attach the two legs to one of the hip sockets separately;

a means for producing motion; and a means for triggering said motion producing means when the interactive posable toy is positioned in a specific configuration, wherein when the interactive posable toy is positioned in said specific configuration, the triggering means triggers the motion producing means to produce motion responsive to the specific configuration.

7. The interactive posable toy of claim 6 further comprising:

a means for emitting sounds; and a means for triggering said sound emitting means when the interactive posable toy is positioned in said specific configuration, wherein when the interactive posable toy is positioned in said specific configuration, the triggering means triggers the sound emitting means to emit sounds responsive to the specific configuration.

8. The interactive posable toy of claim 7 further comprising:

a power source; and an integrated circuit coupled to the power source, the sound emitting means, the motion producing means and the triggering means, the integrated circuit when triggered by the triggering means, controls the sound emitting means and the motion producing means to emit sounds and produce motion.

9. The interactive posable toy of claim 8, wherein the triggering means includes:

a first triggering means configured to send signals to the integrated circuit when the arms and the legs are moved to specific positions, wherein the integrated circuit upon receiving said signals controls the sound emitting means and said motion producing means to emit sounds and produce motion indicative of said specific positions.

10. The interactive posable toy of claim 9, wherein the first triggering means comprises:

a brush attached to each shoulder and hip joint and corresponding to one of the arms and one of the legs; and a wiper board having contacts and in communication with one of the brushes and in communication with the integrated circuit, such that when an arm or a leg is positioned in a specific position, the corresponding brush connects with the contacts on the wiper board and sends a signal to the integrated circuit.

11. The interactive posable toy of claim 9, wherein the triggering means includes:

a second triggering means configured to send signals to the integrated circuit when the interactive posable toy is in a prone and upright position, wherein the integrated circuit upon receiving said signals from the first and second triggering means controls the sound emitting means and said motion producing means to emit sounds and produce motion indicative of said specific positions.

12. The interactive posable toy of claim 11 wherein the second triggering means includes a gravity switch housed in the upper torso.

13. The interactive posable toy of claim 11, wherein the triggering means includes:

a third triggering means configured to send signals to the integrated circuit when the arms are extended to a substantially horizontal position, wherein the integrated circuit upon receiving said signals from the first, second and third triggering means controls the sound emitting means and said motion producing means to emit sounds and produce motion indicative of the configuration of the posable toy.

14. The interactive posable toy of claim 13, wherein the third triggering means includes:

a switch housed in the upper torso and coupled to the integrated circuit;

a rod having two ends and extending through an shoulder joint such that one end is in communication with a ball joint; and a spring positioned between the rod and the switch, the spring biasing the rod outwardly from the upper torso, wherein when the arm is extended substantially perpendicular from the upper torso the flat area of the ball joint permits the spring to bias the rod outwardly away from the upper torso causing the spring to form an open contact with the switch and sends a signal to the integrated circuit.

15. The interactive posable toy of claim 13 wherein the head includes a neck pivotally attached to the upper torso, the neck including a fourth triggering means configured to send signals to the integrated circuit when the head is positioned in specific positions, and as long as the arms, legs and torso are positioned in a specific position the integrated circuit triggers the sound emitting means and said motion producing means to emit sounds and produce motion indicative of the configuration of the posable toy.

16. The interactive posable toy of claim 15 wherein the fourth triggering means includes:

a brush attached to the neck; and a wiper board having contacts and in communication with the brush and in communication with the integrated circuit, such that when the neck is positioned in a specific position the brush connects with the contacts on the wiper board and sends a signal to the integrated circuit, wherein as long as the arms, legs and torso are positioned in a specific position the integrated circuit triggers the sound emitting means and said motion producing means.

17. The interactive posable toy of claim 15 wherein the motion producing means includes:

a motor coupled to the power source and the integrated circuit;

gear mechanisms attached to the motor and coupled to a first and second cam;

a lifter laterally connected to the first cam attached to the upper torso, such that when the motor is operative the first cam may laterally rock the upper torso; and the second cam acting on the lower torso and attached to the mid-section, such that when the motor is operative the second cam may tilt the mid-section relative to the lower torso.

18. The interactive posable toy of claim 17 wherein the sound emitting means comprises a speaker unit coupled to the circuit and the power source.

19. The interactive posable toy of claim 7 wherein the ball joint housing is defined as having a base and a peak and being substantially domed shape, and wherein the slot is defined from the base to an eccentric portion at the peak, such that when a force is applied against the arm moving the ball joint to the eccentric portion, the force is redirected causing the shoulder joint and in turn the ball joint housing to rotate about the shoulder socket until the slot moves in front of the force causing the arm to move from the eccentric portion to the base.

20. The interactive posable toy of claim 7 further comprising:

two hands separately attached to the two arms; and a fifth means for triggering the sound emitting means and the motion emitting means positioned in at least one of the hands and responsive to receiving a specific object, wherein when the hand receives said specific object, the fifth triggering means triggers the sound emitting means and the motion emitting means to emit sound and produce motion responsive to the specific object.

21. The interactive posable toy of claim 20 wherein the specific object is a steering wheel.

22. The interactive posable toy of claim 7 further comprising:

two feet separately attached to the two legs; and a sixth means for triggering the sound emitting means and the motion emitting means positioned in at least one of the feet and responsive to connecting to a specific object, wherein when the foot receives said specific object the sixth triggering means triggers the sound emitting means and the motion emitting means to emit sound and produce motion responsive to the specific object.

23. The interactive posable toy of claim 22 wherein the specific object is a pair of roller blades.

24. The interactive posable toy of claim 22 wherein the specific object is a skate board.

25. An interactive role-playing posable toy comprising:

a torso having at least two sockets, each socket being sized accordingly to pivotally and rotatably receive a joint, each joint further being attached to an appendage;

a means for emitting electronic sounds; and a means for triggering said sound emitting means when the at least one appendage is positioned in a specific position, wherein when a user positions the at least one appendage in the specific position, the triggering means triggers the sound emitting means to emit electronic sounds responsive to the specific position.

26. The interactive role-playing posable toy of claim 25 further comprising:

a means for producing motion; and a means for triggering said motion producing means when the at least one appendage is positioned in a specific position, wherein when the at least one appendage is positioned in said specific position, the triggering means triggers the motion producing means to produce motion responsive to the specific position.

27. The interactive role-playing posable toy of claim 25 further comprising a means for triggering said sound emitting means and said motion producing means responses to specific configurations of the torso.

* * * * *